US006395317B1

(12) United States Patent
Singh et al.

(10) Patent No.: US 6,395,317 B1
(45) **Date of Patent: *May 28, 2002**

(54) PROCESS AND APPARATUS FOR FORMING DUAL COMPARTMENT POUCHES FROM A CONTINUOUS WEB

(75) Inventors: Balbir Singh, Media; David A. Blythe, Philadelphia, both of PA (US); Stephen R. Holten, Pasadena, CA (US); Gary Willison, Houston, TX (US)

(73) Assignee: Mars Incorporated, McLean, VA (US)

( * ) Notice: Subject to any disclaimer, the term of this patent is extended or adjusted under 35 U.S.C. 154(b) by 30 days.

This patent is subject to a terminal disclaimer.

(21) Appl. No.: 09/586,579

(22) Filed: Jun. 2, 2000

Related U.S. Application Data

(63) Continuation-in-part of application No. 09/248,865, filed on Feb. 11, 1999, now Pat. No. 6,153,232.

(51) Int. Cl.[7] ..... B65D 81/34

(52) U.S. Cl. ..... 426/113; 426/123; 53/329; 383/97; 383/207; 383/209; 206/5

(58) Field of Search ..... 426/79, 82, 113, 426/123; 53/329; 383/97, 207, 209; 206/5

(56) References Cited

U.S. PATENT DOCUMENTS

| | | | | |
|---|---|---|---|---|
| 2,145,941 A | | 2/1939 | Maxfield | 93/3 |
| 3,114,643 A | * | 12/1963 | Boston et al. | 426/113 |
| 3,199,437 A | * | 8/1965 | Nelsen | 426/113 |
| 3,407,077 A | * | 10/1968 | Helin | 426/113 |
| 3,615,712 A | | 10/1971 | Keller | 99/171 |
| 3,819,089 A | | 6/1974 | Scales | 222/55 |
| 3,829,007 A | | 8/1974 | Ellison | 229/55 |
| 3,830,944 A | * | 8/1974 | Dimitriadis et al. | 426/113 |
| 3,873,735 A | | 3/1975 | Chalin et al. | 426/87 |
| 3,895,118 A | | 7/1975 | Rambold et al. | 426/87 |

(List continued on next page.)

FOREIGN PATENT DOCUMENTS

| | | |
|---|---|---|
| DE | 7540166 | 4/1976 |
| DE | 4017363 | 12/1991 |
| DE | 19716141 | 10/1997 |
| EP | 0478812 | 4/1992 |
| EP | 0499647 | 8/1992 |
| EP | 0561654 | 9/1993 |
| GB | 12680 | 10/1911 |
| GB | 1013663 | 12/1965 |
| GB | 2117350 | 10/1983 |
| GB | 2171077 | 8/1986 |
| GB | 2276138 | 9/1994 |
| GB | 2283007 | 4/1995 |
| JP | 5791164 | 7/1982 |

*Primary Examiner*—Nina Bhat
(74) *Attorney, Agent, or Firm*—Fulbright & Jaworski, L.L.P.

(57) ABSTRACT

The present invention is directed to process and apparatus for forming a dual compartment package. The process includes forming an elongated rectangular U-shaped package having an inside and outside wall configured to form an open top end, and an inside and outside wall configured to form an open bottom end. The U-shaped package is filled with product. A zipper assembly having inter-locking members is separated into a first zipper component and a second zipper component. The first zipper component is attached to the inner side of the open top end walls thereby sealing the top end to the first zipper component. The open bottom end walls are placed adjacent the first zipper component, and the second zipper component is reattached to the first zipper component thereby locking the open bottom end walls between the inter-locking members of the zipper assembly. The U-shaped package forms two compartments that are separately filled with a product, in which the product is dispensed from the bottom end of the package after one of the interlocking members is released from the sealing/release assembly. The dual compartment package can also be formed with two separate compartments.

26 Claims, 6 Drawing Sheets

U.S. PATENT DOCUMENTS

| | | | | | |
|---|---|---|---|---|---|
| 4,055,109 | A | | 10/1977 | Kan | 93/35 |
| 4,216,639 | A | | 8/1980 | Gautier | 53/413 |
| 4,290,521 | A | | 9/1981 | Mitchell | 206/0.5 |
| 4,358,466 | A | * | 11/1982 | Stevenson | 426/106 |
| 4,361,235 | A | | 11/1982 | Gautier | 206/527 |
| 4,453,370 | A | | 6/1984 | Titchenal | 53/455 |
| 4,514,426 | A | * | 4/1985 | Jordan et al. | 426/113 |
| 4,601,157 | A | | 7/1986 | Adelman | 53/450 |
| 4,605,123 | A | | 8/1986 | Goodrum et al. | 206/0.5 |
| 4,631,901 | A | | 12/1986 | Chung et al. | 53/455 |
| 4,651,870 | A | | 3/1987 | Giambalvo | 206/0.5 |
| 4,693,056 | A | | 9/1987 | Raszewski | 53/450 |
| 4,774,797 | A | | 10/1988 | Colamussi et al. | 53/459 |
| 4,787,755 | A | | 11/1988 | Branson | 383/65 |
| 4,796,300 | A | | 1/1989 | Branson | 383/63 |
| 4,810,109 | A | | 3/1989 | Castel | 383/105 |
| 4,864,802 | A | | 9/1989 | D'Angelo | 53/450 |
| 4,879,124 | A | * | 11/1989 | Oberle | 426/113 |
| 4,890,439 | A | | 1/1990 | Smart et al. | 43/410 |
| 4,923,701 | A | * | 5/1990 | Van Erden | 426/113 |
| 4,937,410 | A | | 6/1990 | Anderson | 219/10.55 |
| 4,950,859 | A | | 8/1990 | Anderson | 219/10.55 |
| 5,044,777 | A | | 9/1991 | Watkins et al. | 383/100 |
| 5,058,364 | A | | 10/1991 | Seiden et al. | 53/455 |
| 5,181,365 | A | | 1/1993 | Garvey et al. | 53/455 |
| 5,222,813 | A | | 6/1993 | Kopp et al. | 383/200 |
| 5,342,634 | A | * | 8/1994 | Murata et al. | 426/113 |
| 5,366,741 | A | | 11/1994 | Van Der Zon | 426/79 |
| 5,419,437 | A | | 5/1995 | Huseman | 206/554 |
| 5,552,165 | A | | 9/1996 | Haak et al. | 426/80 |
| 5,827,559 | A | * | 10/1998 | Powell | 426/412 |
| 5,863,585 | A | | 1/1999 | Sjöberg | 426/389 |
| 5,914,142 | A | * | 6/1999 | Zartner | 426/113 |

* cited by examiner

PROCESS AND APPARATUS FOR FORMING DUAL COMPARTMENT POUCHES FROM A CONTINUOUS WEB

SPECIFICATION

This is a continuation-in-part application of application U.S. Ser. No. 09/248,865 filed Feb. 11, 1999 U.S. Pat. No. 6,153,232 for a boil-in-bag package.

FIELD OF THE INVENTION

The present invention is related to a process and apparatus for forming a dual compartment storage and cooking package for food items such as a boil-in-bag package that includes a bag with a handle and a sealing and release mechanism for easily dispensing the food item from the package. More specifically, the present invention is directed to a dual compartment pouch and a process and apparatus for forming it from a continuous web of material.

BACKGROUND OF THE INVENTION

The use of pouch-type packages or plastic bags for packaging, storing and subsequent cooking or heating of various food items by suspending the bag in boiling water or by microwave is commonplace. Such a plastic pouch or bag for cooking is described in U.S. Pat. Nos. 3,615,712 and 3,819,089. In practice, the plastic bags are typically formed in a tubular configuration, cut to length and sealed at one end. After being filled with the desired contents, such as rice or other food items, the bags are typically sealed at the remaining opened end.

Many forming processes and apparatuses are known for converting a web of flexible material into these individual pouches, which may be made in-line with filling and final sealing stations. Such typical machines are generally classified as either horizontal type or vertical type forming machines. Such machines employ mechanisms for continuously moving the webbed material through the various stations of the machine, or they may intermittently move the webbed material while controlling the various operations to occur during rest periods between movements.

Pouches that are formed from a continuous web of flexible material are described in U.S. Pat. No. 4,774,797 to Colamussi et al., U.S. Pat. No. 4,453,370 to Titchenal and U.S. Pat. No. 4,631,901 to Chung et al. An example of a horizontal forming machine with intermittent movement that is used to manufacture relatively complex individual food containers from a continuous web of material is described in U.S. Pat. No. 4,361,235 to Gautier. Such known processes initially include folding a continuous web of material into two sidewalls with a bottom gusset extending therebetween in a generally W shape. Thereafter, various heat sealing and cutting operations are sequentially performed between intermittent movements of the web to produce specialized packages. U.S. Pat. No. 5,181,365 to Garvey et al. also describes a process and apparatus for producing individual product pouches with horizontal-type-form-fill-seal machines. The Garvey et al. patent describes forming pouches from a continuous supply of flexible webbed material by folding the material into two sidewalls and a bottom gusset and performing one or more forming operations on only one of the gusset portions and lower sidewall combinations at a time. During the forming operations, a separation element is inserted within the bottom gusset to effectively isolate one of the gusset portions and lower sidewall combinations from the other.

It is also well known to have plastic sealing and release mechanisms, such as zipper closure structures on these pouches. As discussed above, the pouches are typically made in a continuous form and must be separated from adjoining pouches at a line of separation. Typically, the closed zipper is supplied from a roll and is fed to the pouch forming machine and placed in proximity to the upper end of the folded sheet of material forming the front and the rear panels of the pouch. The zipper is bonded to the opposite side wall surfaces of the pouch and the opposite side edges of the pouch are sealed along lines extending transversely to the elongated zipper, passing through the mass in the zipper. Because of the mass of the zipper structure, sealing the sides of the pouch in the area of the zipper structure has been a problem. As solution to this problem has been described in U.S. Pat. No. 5,906,438 to Laudenburg in which the mass of the plastic zipper structure is reduced at opposite side edges of the pouch by forming holes passing through the interlocking tongue and groove portion of the zipper so that the subsequent heating of the side edges of the pouch results in sealing of the pouch side edges with less time and heat that otherwise would be required. See also U.S. Pat. No. 4,246,228 to Sandborn, Jr.

Thus, an object of the invention is to provide a dual compartment pouch and a process for forming a U-shaped tubular pouch having two inside walls and two outside walls that form a two compartment pouch.

Another object of the invention is to provide a tubular pouch having a zipper fastener that mechanically closes the open ends of the pouch by trapping the pouch film within the zipper profile.

A further object of the invention is to provide a U-shaped tubular pouch in which the contents are dispensed from the bottom of the pouch.

A further object of the invention is to provide a process for applying a zipper fastener to pouch film in which one portion of the zipper fastener is sealed to the film and the other portion of the zipper fastener is used to re-close an open end of the pouch.

SUMMARY OF THE INVENTION

The subject invention is directed to a dual compartment package for storage and cooking and/or delivery of consumable products. The package is formed from an elongated rectangular shaped bag section that forms a U-shaped package having two inside walls, two outside walls, and open top and bottom ends. A handle section is adjacent the top and bottom ends in which the handle section has an upper and a low portion, and a first and second side. The package also includes a sealing/release assembly having two interlocking members configured to releaseably close at least one of the two open ends of the U-shaped package by capturing at least one of the two open ends between the two interlocking members, the sealing/release assembly is positioned on the handle section. The U-shaped package forms two compartments that are separately filled with a product, in which the product is dispensed from the bottom end of the package after one of the interlocking members is released from the sealing/release assembly.

The dual compartment package can also be formed with a seal between the two compartments of the U-shaped package thereby preventing the intermingling of the products contained in the two compartments. In this embodiment the two open ends are captured between the two interlocking members of the sealing/release assembly and the product is dispensed from the top and bottom ends of the package after one of the interlocking members is released from the sealing/release assembly.

The invention is also directed to a process and apparatus for forming a dual compartment package that includes forming an elongated rectangular U-shaped package having an inside and outside wall configured to form an open top end and an inside and outside wall configured to form an open bottom end. The two compartments of the U-shaped package are filled with product. A zipper assembly having inter-locking members is separated into a first zipper component and a second zipper component. The first zipper component is attached to the inner side of the open top end walls thereby sealing the top end to the first zipper component. The open bottom end walls are placed adjacent the first zipper component and the second zipper component is reattached to the first zipper component thereby locking the open bottom end walls between the inter-locking members of the zipper assembly.

BRIEF DESCRIPTION OF THE DRAWINGS

The invention will become more apparent when the detailed description of the exemplary embodiment is considered in conjunction with the appended drawings in which.

DETAILED DESCRIPTION OF THE PREFERRED EMBODIMENT

Figure 1:
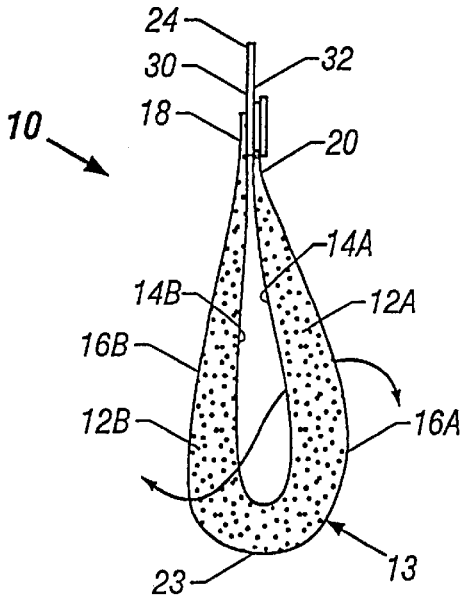
FIG. 1 is a side plan view of a dual compartment package formed by the method and apparatus of the present invention.

An example of a pouch that can be formed using the process and apparatus of the present invention is a dual compartment package 10 illustrated in FIGS. 1–5 of the drawings. The dual compartment package can be used for the storage, cooking and/or delivery of consumable items. The dual compartment package 10 has a bag section 13 with two inside walls 14A and 14B and two outside walls 16A and 16B forming two compartments 12A and 12B. The package 10 also has a top end 18, a bottom end 20, a center section 23 and a zipper assembly 36 consisting of a zipper header/handle (male) 24 and a zipper fastener (female) 40. Bag section 13 can include perforations 21 over a significant portion of its surface. Following the filling of both compartments 12A and B with product, the top end 18 is sealed to the zipper header/handle 24 and thereby closed. The zipper header/handle 24 can be attached to the top end 18 or can be formed as part of the top end 18 of bag section 13. Header/handle section 24 has an upper portion 26, a lower portion 28, a back side 20 and a front side 32. The upper portion 26 includes a slot or oval-shaped opening 33 for lifting the package 10 from boiling water.

The zipper header/handle 24 includes a sealing/release mechanism 34 that engages with zipper fastener 40 thereby capturing and closing the open bottom end 20 of bag section 13, thus forming a U-shaped or folded bag that allows for a through-flow of boiling water between the inside walls 14A and B (FIG. 1). In an alternate embodiment, the zipper assembly 36 could be replaced with a top seal and tear-strips, as is known to one skilled in the art.

Figure 1A:
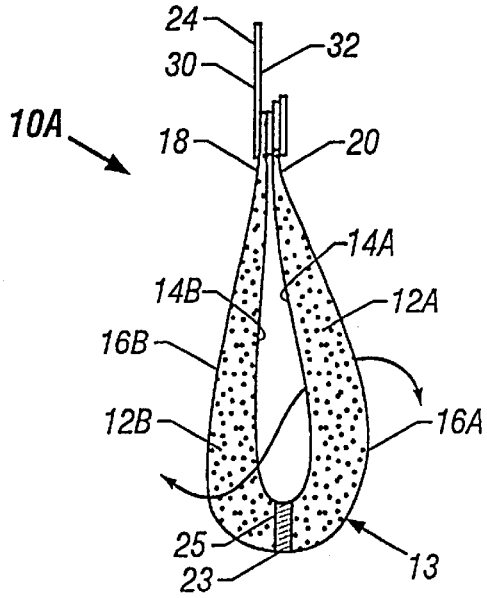
FIG. 1A is a side plan view of an alternate embodiment of a dual compartment package with separated compartments formed by the method and apparatus of the present invention.

In an alternate embodiment (FIG. 1A), a dual separated compartment package 10A is created by providing a bottom seal 25 in the center section 23 of bag section 13. The bottom seal 25 divides the tubular bag section 13 into two separate compartments 12A and B. In the dual compartment package 10A, both compartments 12A and 12B are filled with a component that is desired to be kept separate until ready for mixing. Following the filling operation, the zipper header/handle 24 is applied in such a way as to allow the zipper fastener 40 to capture and close both open ends 18, 20. In an alternate embodiment of the dual compartment pouch 10A, the zipper assembly 36 could be replaced with a top seal and tear-strips, as is know to one skilled in the art.

The zipper header/handle 24 can be formed from a material such as polyolefin having a specific gravity less than that of water, thereby allowing it to float for easy retrieval from boiling water.

Handle 24 also provides a place for the sealing/release mechanism 34 that is away from the hot surfaces of package 10, 10A and the hot food product. The sealing/release mechanism 34 allows the open bottom end 20 to be released from the handle section 24 without the consumer having to contact the hot package 10, 10A (FIG. 5).

Figure 2:
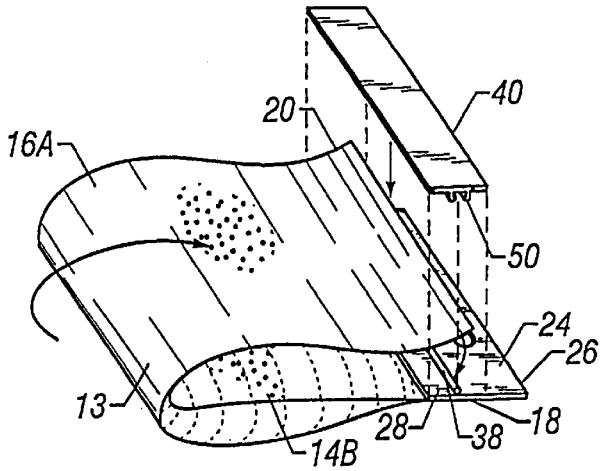
FIG. 2 is a perspective view of the embodiment of FIG. 1 illustrating a placement of the bottom end of the bag contiguous with the handle section and the placement of the sealing/release mechanism.
Figure 3:
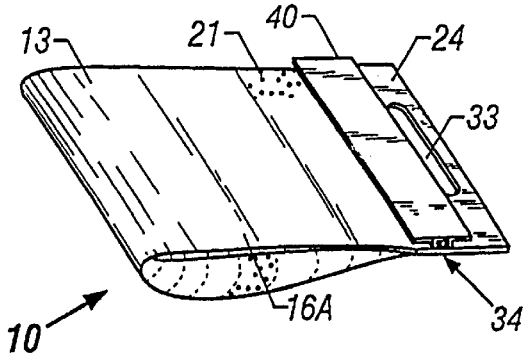
FIG. 3 is a perspective view of the dual compartment package of FIG. 1 illustrating a sealed package.
Figure 4:
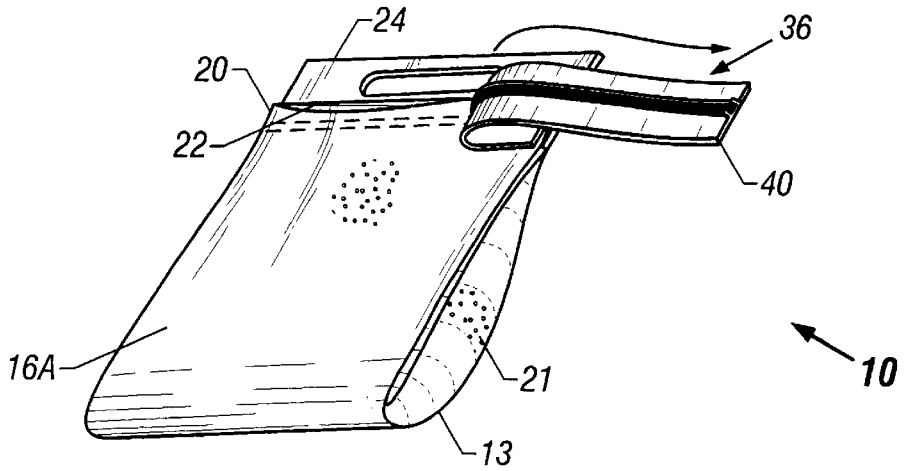
FIG. 4 is a front perspective view of the dual compartment package illustrating disengagement of the sealing/release mechanism.
Figure 5:
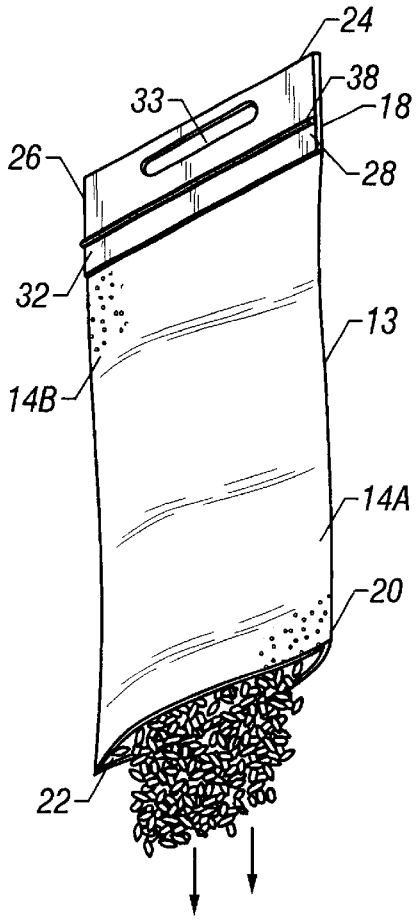
FIG. 5 is a perspective view of the package of FIG. 1 illustrating the dispensing of a food item from the bottom of an open package.

The sealing/release mechanism 34 can be a zipper fastener 40 attached to handle section 24 in such a manner so as to engage and close the bottom end 20 of package 10 contiguous with the handle 24 (FIGS. 1–5). Package 10 is opened by pulling apart a portion of the zipper fastener 40, thus releasing the open bottom end 20 of package 10 in order to dispense the rice or food product from the package (FIG. 5). In the dual compartment package 10A, the removal of a portion of the zipper fastener 40 would release the contents from both compartments 12A and B. In one embodiment the zipper assembly 36 includes a zipper header/handle 24 with a male member 38 and a zipper fastener 40 with a female member 50 in which the male member 38 is positioned on the lower portion 28 of the front side 32 of handle section 24. The placement of the handle 24 is such that it is adjacent the inside wall 14B of bag section 13 as shown in FIGS. 1 and 2. Zipper fastener 40 can generally be about half the width of the handle section 24 (FIGS. 3 and 4). The placement of the male and female members 38 and 50 can be reversed so that the female member 50 is on the handle portion 24 and the male member 38 is on the zipper fastener 40.

The zipper fastener 36 is constructed and arranged for selected interlocking. The interlocking members of the zipper assembly 36 can be of any known configuration in the art of zipper fasteners. The two members 38, 50 can be interlocked with each other through the inside and outside walls 14A and 16A of the bag section 13 as illustrated in FIGS. 2–4. Alternatively, in the dual package 10A, (FIG. 1A) both bag ends 18 and 20 would be placed between the interlocking members of zipper assembly 36. Package 10, 10A preferably has a zipper fastener 36 sized from a range of generally about 4.5 to 6 inches and a bag 13 length from a range of generally about 10.5 to 14 inches. However, other dimensions of zipper fasteners 36 and bag lengths are contemplated.

The flexible web material used to form the bag section 13 can comprise any known flexible material used in the making of product packages, such as films, laminates, nonwovens, wovens, etc. with regard to the packaging of food, such materials should be acceptable for such use. It is also preferable that the material be heat sealable to itself so that the sealing operation can be performed by known heat sealing techniques. An example of heat-sealable plastics are polyolefins and nylons. This plastic film can have a thickness of 0.25 to 5 mil, with a range of 0.5 to 3 mil and preferably a range of 1.25 to 2 mil. Zipper assembly 36 can be formed from any suitable polymeric material known to those skilled in the art. In a preferred embodiment, zipper assembly 36 is formed from polypropylene.

A process for forming the dual compartment package can generally be described as follows. Film stock that is non-perforated, pre-perforated or perforated on-line can be used to construct the bag section 13. Dual continuous webs of package film 58 of a material described above, are pulled into the machine and the sides of individual bags on the continuous ribbon are sealed. If desired, one or both of the corners of the bottom ends can be beveled. The continuous ribbon is then V-folded to form the U-shape of the package or bag. Each side of the U-shaped bag is then opened and filled with the food product such as rice, or any other suitable product. The handle sections 24 are attached to the top ends 18 of the bag section 13, thereby closing the top end 18 of bag section 13. Alternatively, a handle section can be formed from a section of the top end 18 of the bag section 13. The zipper fasteners 40 are attached to the bag section 13 in a way that allows the walls of the open bottom end 20 to be interposed between the sealing/release mechanism 34, thus closing the open bottom end 20 of each package 10. Punch assemblies 132, 134 die cut the forkslit 33 and side zipper cut-outs 134A prior to separating the individual packages. The continuous ribbon is then cut through the side seals 72 and zipper assembly 36 to separate the multiple packages.

In an alternate embodiment, the process can be used for forming dual, separated compartment packages 10A designed for the simultaneous packaging of items which need to be kept separate until desired (e.g., dry rice or pasta/dry seasoning mix, dry rice or pasta/wet sauce mix, or non-food products requiring separation). A process for forming the dual compartment packages can generally be described as follows. Film stock that has either barrier or non-barrier characteristics is used to construct the dual compartment packages. Dual continuous webs of film of a material 58 described above, are pulled into the machine and the sides of individual packages on the continuous ribbon are sealed. The continuous ribbon is V-folded to form the U-shape of the package. The bottom edge of the U-shaped package is sealed to divide the tube into two distinct separated compartments. Each side of the U-shaped package is then opened and filled with one of the two component products. The handle sections 24 are attached to the dual packages 10A, and zipper fasteners 40 are attached in a way that allows the walls of both open ends 18, 20 of bag section 13 to be interposed between the zipper sealing/release mechanism 34, thus simultaneously closing both open ends of the package 10A. Punch assemblies 132, 134 die cut the forkslit 33 and zipper cut-outs 134A respectively in the handle section 24 and the continuous ribbon of filled and closed packages is then cut through at the side seals 72 and the handle/zipper assembly 36 to separate the multiple packages.

Figure 6:
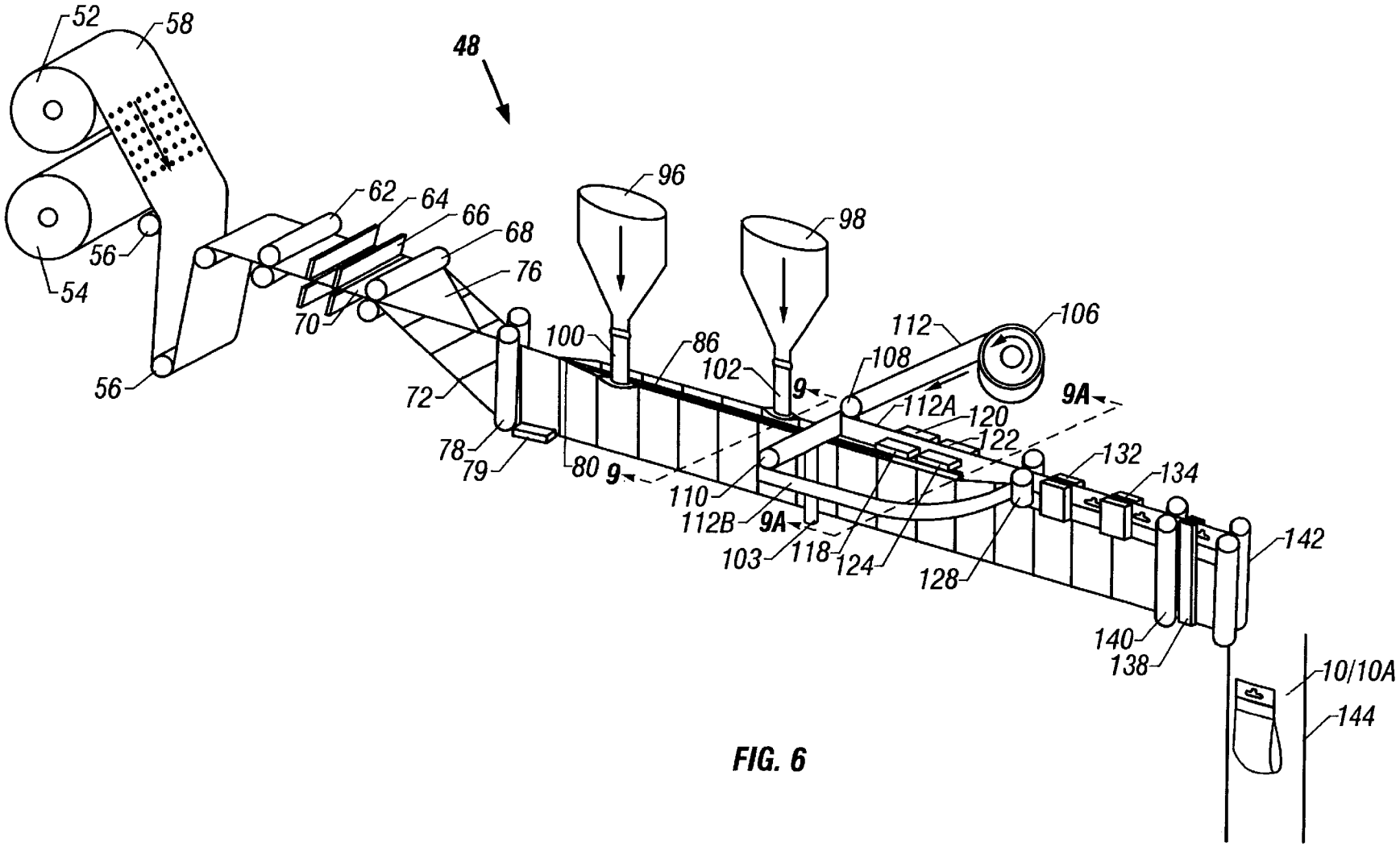
FIG. 6 is a schematic view in perspective of a process and apparatus in accordance with the present invention.
Figure 7:
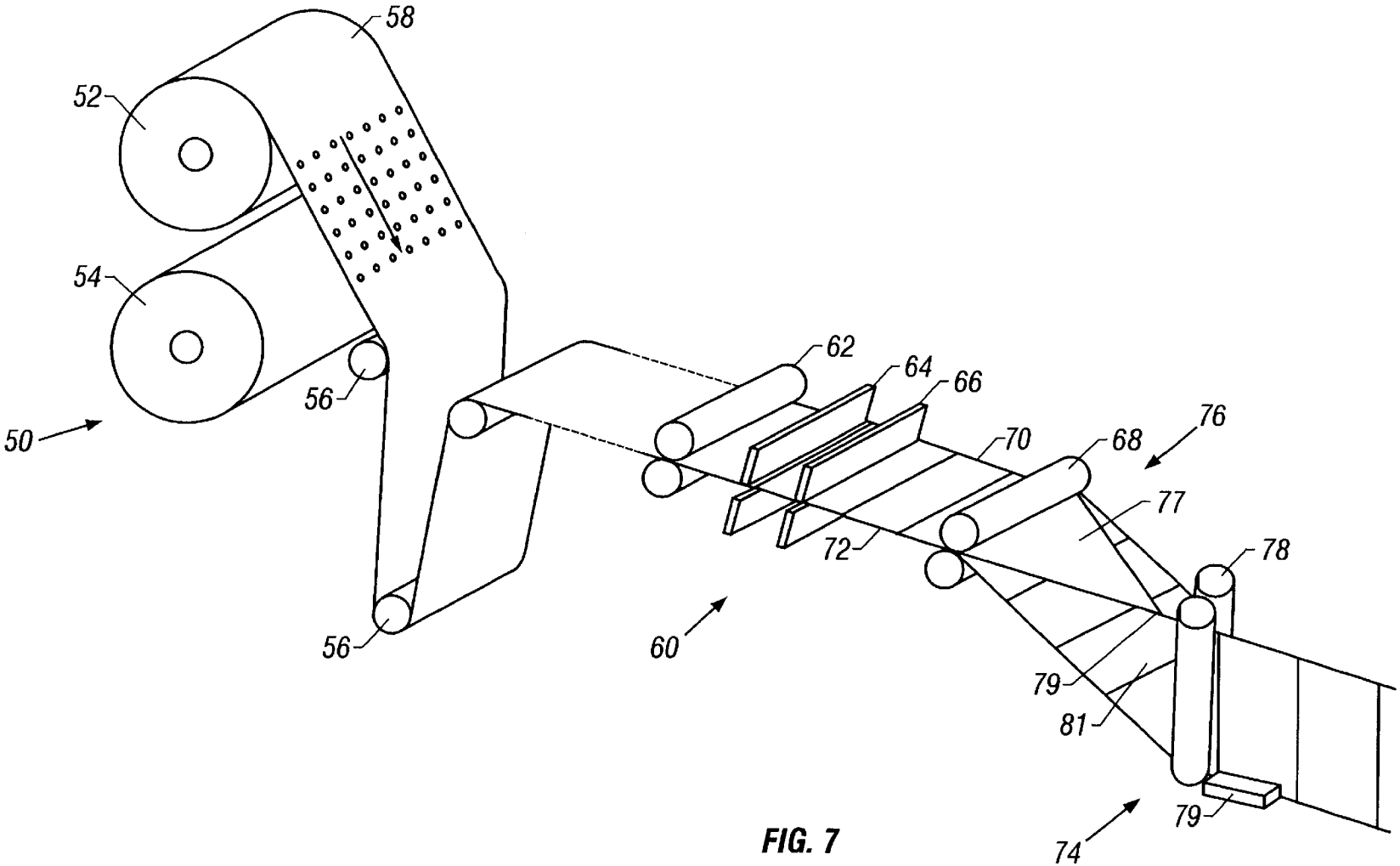
FIG. 7 is a schematic view in perspective of a portion of the process and apparatus of the present invention.
Figure 8:
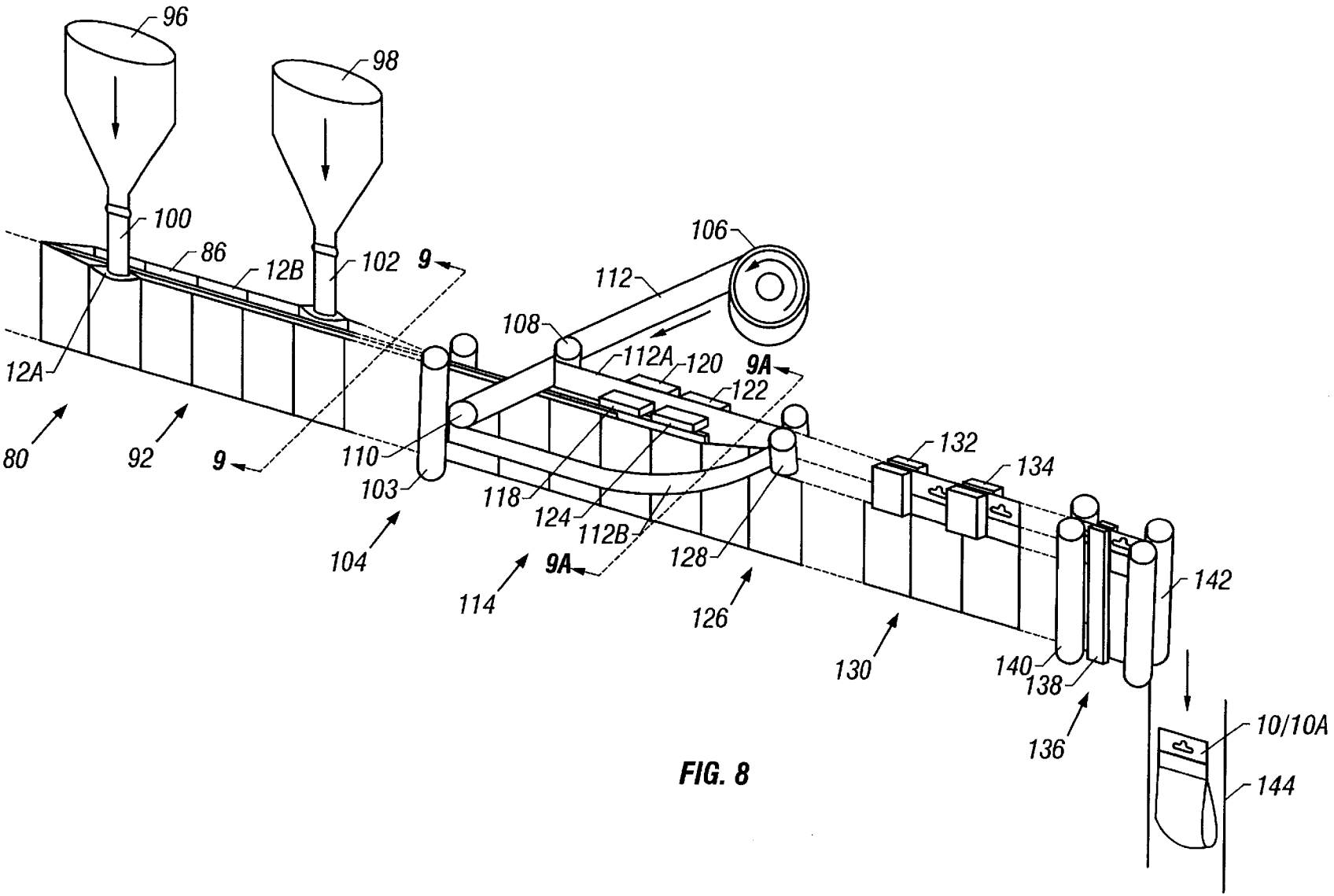
FIG. 8 is a schematic view in perspective of a second portion of the process and apparatus of the present invention.

An apparatus or machine 48 for performing the above described process includes a number of different operational sections (FIGS. 6–8). The first section is identified as a film feed section 50 which consists of dual film unwinds 52, 54 and a dancer roll assembly 56 (FIGS. 6 and 7). In one embodiment, two rolls of pre-perforated film stock 58 are simultaneously unwound, pulled through the dancer roll assembly 56, which controls film tension, and is fed into a side sealing section 60. In an alternate embodiment, one double-wide roll of un-perforated film stock 58 is unwound, perforated on-line, and slit into two equal halves. Each half is turned 90 degrees, and placed one over the other, then pulled through the dancer roll assembly 56 and fed into the side sealing section 60. In another alternate embodiment, film stock with barrier or non-barrier characteristics is slit on-line and fed to the machine 48 as described above.

The side sealing section 60 consists of feed rolls 62, heat seal bars 64, cold seal bars 66, and tension rolls 68 (FIGS. 6 and 7). The two layers of film 58 are pulled into the side sealing section 60 by the feed and tension rolls 62, 68 and are sealed together by the heat seal bars 64, thereby forming a two-layer film ribbon 70. The sealed area 72 is then cooled by the cold seal bars 66 to quench the sealed area 72 and prevent unwanted stretching. The heat sealing bars 64 include conventional heating elements which are connected by electrical wires to an electrical source in a conventional manner. The heating elements are electrically heated to raise the temperature of the heating bar 64 above the temperature necessary to perform a heat sealing operation depending on the melt temperature of the flexible webbed material that is chosen. The tension rolls 68 are directly coupled to the feed rolls 62 in a one-to-one ratio that prevents stretching or breakage in the sealed area 72 of the continuous film ribbon 70. The side sealing section 60 is equipped with a mechanical variable speed adjustment, known to one skilled in the art, that allows for the coordination of the feed/tension roller speed with that of downstream pull station rollers, thereby controlling film tension throughout the operation of the machine 48.

Figure 9:
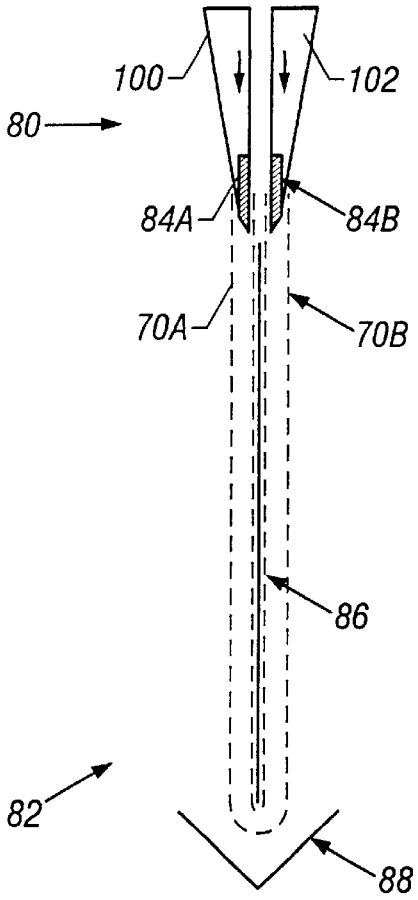
FIG. 9 is a transverse cross-sectional view taken along lines 9—9 of FIGS. 6 and 8.
Figure 9A:
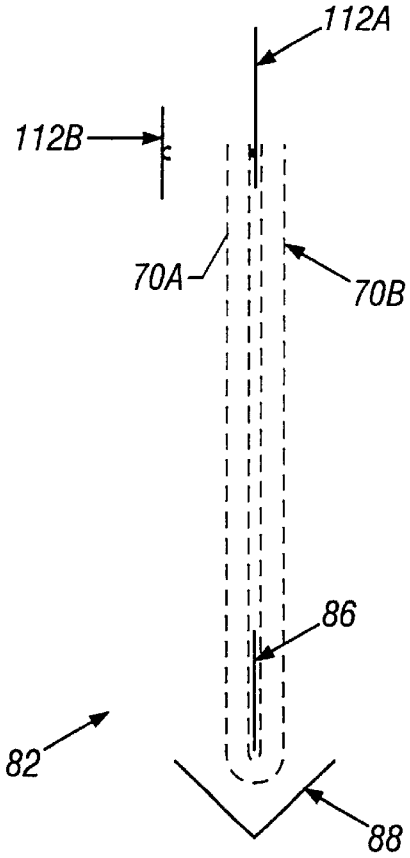
FIG. 9A is a transverse cross-sectional view taken along lines 9A—9A of FIGS. 6 and 8.

The next section is the folding section 74 that consists of a plow 76 and stationary bars 78 at the plow discharge 81 (FIGS. 6 and 7). The plow assembly 76 typically comprises a triangular plate 77 having a nose portion 79. The downstream stations pull the side sealed two-layer film ribbon 70 over the plow assembly 76 thereby folding the film ribbon 70 into the U-shape of the package 10, 10A. The stationary bars 78 of the plow discharge 81 assure correct film placement as the film ribbon 70 enters a film separation 80 (FIGS. 6, 8 and 9) and pouch support assembly 82 (FIGS. 9 and 9*a*). Alternatively, machine 48 can have a bottom sealing assembly 79 just downstream of the folding plow 76 (FIGS. 6 and 7). This sealing assembly 79 divides the U-shape bag section 13 into two distinct separate compartments 12A and B if the separate dual compartment package 10A is desired.

The film separation assembly 80 consists of two film separation bars 84*a* and *b* which separate the film layers 70*a* and *b* of the film ribbon 70 for the filling operation 92 (FIGS. 6, 8, and 9). The film separation bars 84*a* and *b* separate the two layers of film 70*a* and *b,* allowing product fillers 100, 102 to extend into the package to deposit the product in each of the two compartments 12A and B of the package 10, 10A. The film separation bars 84*a* and *b* begin at the plow discharge 81 and terminate downstream of the second filling station 98. The pouch support assembly 82, (FIGS. 9, 9A) which begins at the plow discharge 81, consists of one center plate 86 and one bottom support 88. The bottom support 88 runs the entire length of the machine 48 to support the center 23 of the U-shaped package. The center plate 86 is reduced in height downstream of the second filling station 98 (FIG. 9A). The reduced height center plate 86 terminates at the final pull station 142.

The filling section 92 consists of film tracking rollers of a kind known to one skilled in the art, two product fillers 96, 98, two duck-bill fillers 100, 102, a pull station 103 to control film tension during filling, and associated tooling known to one skilled in the art (FIGS. 6 and 8). Optionally, there also may be product settlers (not shown), also know to one skilled in the art, which are used to settle the product out of the top sealing area. Downstream pull stations pull the U-shaped film ribbon 70 through the filling section 92 while the film tracking rollers (not shown) control the location of the film ribbon 70 relative to the duck-bill filler heads 100, 102. One of the filler assemblies, 96, 100 is positioned to fill the front compartment 12A of the package and the other filler assembly 98, 102 is positioned to fill the back compartment 12B. Product fillers 96, 98 deposit a predetermined amount of product into the duck-bill filler heads 100, 102 which then travel down through the separated sides of the film ribbon 70 and deposit a preselected product in a preselected amount into its respective compartment. The package 10A and B receives its total target weight and product components after moving past the second filler 98. Alternately, filling section 92 can consist of a traveling filler assembly thereby decreasing station dwell time and increasing machine speed. In another alternative embodiment, the machine can be equipped with fillers capable of handling the associated component products such as dry product fillers, wet product fillers or positive displacement pumps, etc.

The zipper feed section 104 consists of a motorized unwind station 106, positioned 90 degrees to the film ribbon 70, zipper separation rollers 108 and 110 and machined tracking guides (not shown) (FIGS. 6 and 8). Downstream pull stations pull the zipper assembly ribbon 112 into the machine 48 while the motorized unwind station 106 feeds the zipper assembly ribbon 112 in order to control tension. The zipper assembly ribbon 112 is separated into its two components, a zipper header/handle (male) 112*a* being the first component and a zipper fastener (female) 112*b* being the second component. The two components 112*a* and *b* pass over the two adjacent rollers 108, 110 thereby establishing two initial paths parallel to the machine 48. Zipper tracking guides (not shown) control the precise location of the zipper components 112*a* and *b* as they are pulled into the downstream operations of the machine 48. The zipper header 112*a* is guided into a zipper header sealing section 114 while the zipper fastener 112*b* is guided out and around the zipper header sealing section 114 and back into the zipper closing section 126.

The zipper header sealing section 114, consists of a heat seal bar 120 and backing bar 118, a cooling bar 122 and a backing bar 124, and film tracking rollers and a rocker station (not shown) (FIGS. 6 and 8). A zipper tracking mechanism (not shown) controls the precise location of the zipper header 112*a* while film tracking rollers (not shown) control the position of the film ribbon 70 as they both enter the zipper header sealing section 114. These mechanisms are well know to one skilled in the art. The rocker station (not shown) rolls forward and seals the zipper header ribbon 112*a* to the inside of the film ribbon 70 on the back side 18 of the package 10. As the zipper header ribbon 112*a* moves forward, the sealed region is cooled by the cooling bar 122 in order to quench the seal and prevent heat buildup and possible binding in the downstream zipper closing section. In an alternate embodiment of forming the dual separated compartment package 10A, the machine can spot-seal the zipper header ribbon 112*a* to the outside of the film ribbon 70 on the back side 18 of the package 10A thereby placing the back open end 18 in the interlocking region of the zipper assembly 36.

The zipper closing section 126 consists of a convergent zipper/film track (not shown) and zipper closing rollers 128 (FIGS. 6 and 8). The sealed zipper header ribbon 112*a,* film ribbon 70, and zipper fastener ribbon 112*b* are positioned in the zipper/film track, and pulled through the closing section 126 where the zipper closing rollers 128 reseat the zipper assembly 36 while simultaneously locking the open bottom end 20 of the bag section 13 into the zipper sealing mechanism 34. Alternatively when the dual compartment bag 10A is being formed, the machine 48 positions the film ribbon 70 so that both open ends 18, 20 of the package are interposed between the zipper sealing mechanism 34, thus simultaneously closing both open ends of the package 10A.

Figure 10:
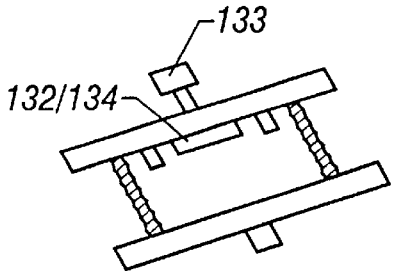
FIG. 10 is a schematic view in perspective of the punch assemblies of FIGS. 6 and 8.
Figure 11:
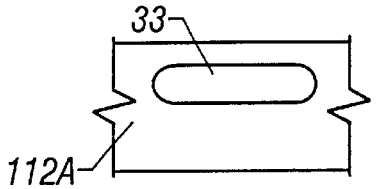
FIG. 11 is a schematic view of the forkslit cutout produced by one of the punch assemblies of FIG. 10.
Figure 11A:
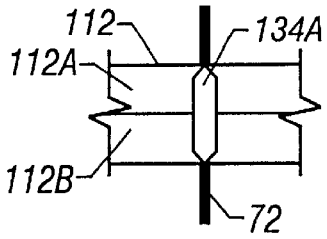
FIG. 11A is a schematic view of the zipper side seal removal cutout produced by the other punch assembly of FIG. 10.

The zipper punch section 130 consists of two die cut punch assemblies 132, 134 and associated stray material removal systems (not shown) known to one skilled in the art (FIGS. 6, 8 and 10). Downstream pull stations 140, 142 pull the closed zipper and film ribbon assembly through the zipper punch section 130. One punch assembly 132 die cuts the forkslit 33 (FIG. 11) in the zipper header 112*a* while the other punch assembly 134 die cuts about a ⅛ inch wide hexagonal section 13A (FIG. 11A) from the side sealed area 72 of the zipper assembly 112 (header and fastener) in preparation for the cutoff operation. The reciprocating die cut punches can be driven by any conventional means and timed in accordance with the operation of the movement of the line, as timed to the drive assembly for the subject apparatus. Preferably, the die cut punches are reciprocally driven by an air cylinder 133, however, other equivalent drive means are contemplated including mechanical, electrical, hydraulic and the like.

The pouch cutoff/discharge section 136 consists of an optional pouch shape containment and support assembly (not shown), a cutoff assembly 138, two pull stations 140, 142 and a pouch discharge chute 144 (FIGS. 6 and 8). The final two pull stations 140, 142 pull the now completed pouch ribbon 70 by the zipper ribbon assembly 112 and are equipped with rollers permitting the passage of the filled packages through the sections. These two pull stations 140, 142 assure proper ribbon tension for the cutoff operation. Each package is optionally shaped, supported, and then cut from the completed pouch ribbon 70 by a cut-off assembly 138, through the center of the side sealed area 72. The actual cutoff mechanism is dependent on the material properties of the film ribbon and could be of a type such as rotary shear, rotary crush, guillotine, scissor-cut, hot-wire, or other method known to one skilled in the art. The separated package 10, 10A is then transferred through the final pull station 142 and falls into a discharge chute 144, while the loose end of the film ribbon 70 is guided into the final pull station 142 for the next cutoff cycle. Alternatively, the pouch ribbon 70 can be taken from the machine, turned 90°, cut, and then discharged to a horizontal belt for further packaging.

The advancement means in accordance with the preferred embodiment of the present invention, advances the webbed material incrementally forward by an amount sufficient to define each individual pouch. The amount of each advancement corresponding to each pouch formed is hereinafter referred to as an index.

Horizontal packaging machines generally consist of a base assembly which contains a variable speed drive unit, a central drive shaft, cam mechanisms and a conveyor drive. The mechanisms performing the various operations in filling and sealing of the bags are mounted on the top of the base assembly. All functions of the machine are operated or timed from the central drive shaft which makes one complete revolution for each bag produced. For each machine revolution or cycle, the flexible web material and formed pouches are indexed forward one station and stopped for performing individual operations. Typically the web or film material is continuously supplied and folded and the side seals are made. The film ribbon is cut into individual pouches which are then filled with product and the top seal closing of the pouch is performed.

Preferably, the advancement means comprises drive rollers which contact with the webbed material so that a single index of the webbed material occurs as the result of a measured rotation of the drive rollers. The drive rollers are conventionally connected with the main drive assembly of the apparatus of the present invention and are controlled in a well known manner to provide such incremental and intermittent indexing of the webbed material. It is contemplated that many other advancement techniques can be utilized instead. For example, in continuous motion machines, draw bars which grab and pull the flexible web material could be easily used. The adjustment or tensioning can be mechanized, electrical, pneumatic, or the like as is well known to one skilled in the art.

The process and apparatus of the present invention, described above, is particularly applicable to intermittent motion type horizontal packaging machines. In order to realize higher production speeds, the process could be easily adapted for such a horizontal machine having a continuous movement by substituting the heat sealing elements, filling elements, cutting dies, and cut-off assemblies with continuous type assemblies. Typically in a continuous motion machine, the heating bars, filling assemblies, cutting dies and cut-off assemblies are rotationally driven in accordance with the timing of the machine and with respect to one another.

One skilled in the art will readily appreciate that the invention is well adapted to carry out the objects and obtain the ends and advantages mentioned as well as those inherent therein. One skilled in the art will also readily appreciate that the elements described herein but not shown are all considered to be known to one skilled in the art of packaging machines. The process and apparatus for forming from a continuous web of material a U-shaped tubular pouch with two compartments and zipper opener described herein are presently representative of the preferred embodiments, are exemplary and are not intended as limitations on the scope of the invention. Changes therein and other uses will occur to those skilled in the art which are encompassed within the spirit of the invention and are defined by the scope of the claims.

What is claimed is:

1. A dual compartment package for storage and cooking or delivery of consumable products, the package comprising:

a) an elongated rectangular shaped bag section forming a U-shaped package having two inside walls, two outside walls, and open top and bottom ends;

b) a handle section adjacent the top and bottom ends, said handle section having an upper and a low portion, and a first and second side;

c) a sealing/release assembly having two interlocking members configured to releaseably close at least one of the two open ends of the U-shaped package by capturing at least one of the two open ends between the two interlocking members, the sealing/release assembly being positioned on the handle section;

d) the U-shaped package forming two compartments that are separately filled with a product, wherein the product is dispensed from the bottom end of the package after one of the interlocking members is released from the sealing/release assembly.

2. The dual compartment package of claim 1, wherein a seal is provided between the two compartments of the U-shaped package thereby preventing the intermingling of the products contained in the two compartments.

3. The dual compartment package of claim 2, wherein two of the open ends are captured between the two interlocking members of the sealing/release assembly.

4. The dual compartment package of claim 3, wherein the product is dispensed from the top and bottom ends of the package after one of the interlocking members is released from the sealing/release assembly.

5. The dual compartment package of claim 1, wherein the sealing/release assembly is a zipper fastener having first and second members configured for selective interlocking.

6. The dual compartment package of claim 1, wherein the package is formed from a heat sealable plastic film material.

7. A process for forming a dual compartment package comprising the steps of:

(a) forming an elongated rectangular U-shaped package having an inside and outside wall configured to form an open top end and an inside and outside wall configured to form an open bottom end, the top end having an inner side;

(b) filling the U-shaped package with product;

(c) separating a zipper assembly having inter-locking members into a first zipper component and a second zipper component;

(d) attaching the first zipper component to the inner side of the open top end walls thereby sealing the top end to the first zipper component;

(e) placing the open bottom end walls adjacent the first zipper component; and (f) reattaching the second zipper component to the first zipper component thereby locking the open bottom end walls between the inter-locking members of the zipper assembly.

8. The process of claim 7, wherein the inter-locking members of the zipper assembly include rib and groove fastener elements.

9. The process of claim 7, wherein the first zipper component is attached to the open top end walls by a heat sealing mechanism.

10. The process of claim 7, wherein the package is formed from a heat sealable plastic film material.

11. The process of claim 7, wherein the zipper assembly further forms a handle section.

12. The process of claim 11, wherein the handle section includes a centrally located forkslit cut-out.

13. The process of claim 7, further including the step of removing a hexagonal shaped section of the zipper assembly along a sealed side area.

14. A process for forming a dual separated compartment package comprising the steps of:

(a) forming an elongated rectangular U-shaped package having an inside and outside wall configured to form an open top end and an inside and outside wall configured to form an open bottom end, the top end having an outer side;

(b) sealing a center portion of the U-shaped package forming a dual separated compartment package;

(c) filling the two compartments of the U-shaped package with product;

(d) separating a zipper assembly having inter-locking members into a first zipper component and a second zipper component;

(e) attaching a portion of the first zipper component to the outer side of the open top end walls;

(f) placing the open bottom end walls adjacent the top end walls and the first zipper component; and (g) reattaching the second zipper component to the first zipper component thereby locking the open top and bottom end walls between the inter-locking members of the zipper assembly.

15. The process of claim 14, wherein the inter-locking members of the zipper assembly include rib and groove fastener elements.

16. The process of claim 14, wherein the first zipper component is attached to the open top end walls by a heat sealing mechanism.

17. The process of claim 14, wherein the package is formed from a heat sealable plastic film material.

18. The process of claim 14, wherein the zipper assembly further forms a handle section.

19. The process of claim 18, wherein the handle section includes a centrally located forkslit cut-out.

20. The process of claim 14, further including the step of removing a hexagonal shaped section of the zipper assembly along a sealed side area.

21. The process of claim 14, further including the step of forming a seal between the two compartments of the U-shaped package thereby preventing the intermingling of the products contained in the two compartments.

22. An apparatus for forming a dual compartment package comprising:

(a) mechanism for continuously supplying two layers of flexible web material;

(b) mechanism for forming spaced transverse seals along the two layers of web material;

(c) mechanism for folding the sealed layers of web material into U-shaped packages having dual compartments, the packages each having an inside and outside wall configured to form an open top end and an inside and outside wall configured to form an open bottom end, the top end having an inner side and an outer side;

(d) mechanism for filling the dual compartments with a product;

(e) mechanism for separating a zipper assembly having inter-locking members into a first zipper component and a second zipper component;

(f) mechanism for attaching the first zipper component to the inner side of the open top end walls sealing the top end to the first zipper component;

(g) mechanism for placing the open bottom end walls adjacent the first zipper component and reattaching the second zipper component to the first zipper component thereby locking the open top and bottom end walls between the inter-locking members of the zipper assembly; and (h) mechanism for separating the individual U-shaped packages from the continuous web material.

23. The apparatus of claim 22, further including a mechanism for die cutting a forkslit in the zipper assembly.

24. The apparatus of claim 22, further including a mechanism for die cutting out a hexagonal shaped section of the zipper assembly along a sealed side area.

25. The apparatus of claim 22, further including a mechanism for forming a seal between the two compartments of the U-shaped package thereby preventing the intermingling of the products contained in the two compartments.

26. The apparatus of claim 25, further including a mechanism for attaching a portion of the first zipper component to the outer side of the open top end walls and placing the open bottom end walls adjacent the top end walls and the first component and a mechanism for reattaching the second zipper component to the first component thereby locking the open top and bottom end walls between the inter-locking members of the zipper assembly.

* * * * *